US006200688B1

(12) United States Patent
Liang et al.

(10) Patent No.: US 6,200,688 B1
(45) Date of Patent: Mar. 13, 2001

(54) NICKEL-IRON BASE WEAR RESISTANT ALLOY

(75) Inventors: Xuecheng Liang, Green Bay, WI (US); Gary R. Strong, Menominee, MI (US)

(73) Assignee: Winsert, Inc., Marinette, WI (US)

( * ) Notice: Subject to any disclaimer, the term of this patent is extended or adjusted under 35 U.S.C. 154(b) by 0 days.

(21) Appl. No.: 09/062,799

(22) Filed: Apr. 20, 1998

(51) Int. Cl.[7] ..... C22C 19/05; F02F 3/00

(52) U.S. Cl. ..... 428/544; 123/188.3; 123/188.8; 148/427; 148/442; 420/453; 420/459; 420/584.1; 420/586.1; 420/588

(58) Field of Search ..... 428/544; 148/427, 148/442; 420/443, 453, 459, 584.1, 586.1, 588; 123/188.3, 188.8

(56) References Cited

U.S. PATENT DOCUMENTS

| | | |
|---|---|---|
| 4,075,999 | 2/1978 | Danis . |
| 4,191,562 | 3/1980 | Silence . |
| 4,228,223 | 10/1980 | Knotek et al. . |
| 4,279,074 | 7/1981 | Zell et al. . |
| 4,292,074 | 9/1981 | Komiyama et al. . |
| 4,430,297 | 2/1984 | Crook . |
| 4,810,464 | 3/1989 | Szereto et al. . |
| 5,246,661 | 9/1993 | Culling . |
| 5,360,592 | 11/1994 | Culling . |

FOREIGN PATENT DOCUMENTS

| | | | |
|---|---|---|---|
| 2929811 | * | 2/1980 | (DE) . |
| 1567524 | * | 5/1980 | (GB) . |
| 57-130714 | | 8/1982 | (JP) . |

* cited by examiner

*Primary Examiner*—Deborah Jones
*Assistant Examiner*—Robert R. Koehler
(74) *Attorney, Agent, or Firm*—Reising, Ethington, Barnes, Kisselle, Learman & McCulloch, P.C.

(57) ABSTRACT

A wear resistant alloy is provided having a composition by weight of 1.0–2.5 C, 1.5–4.5 Si, 8.0–20.0 Cr, 9.0–20.0 W and/or Mo, 0.5–2.0 Nb, 20.0–40.0 Fe, and the balance being Ni (>25.0). This alloy provides excellent wear resistance and good hot hardness with relatively low cost compared to prior art nickel base alloys. The alloy has particular use as a valve seat insert materials in diesel fuel internal combustion engines.

7 Claims, 4 Drawing Sheets

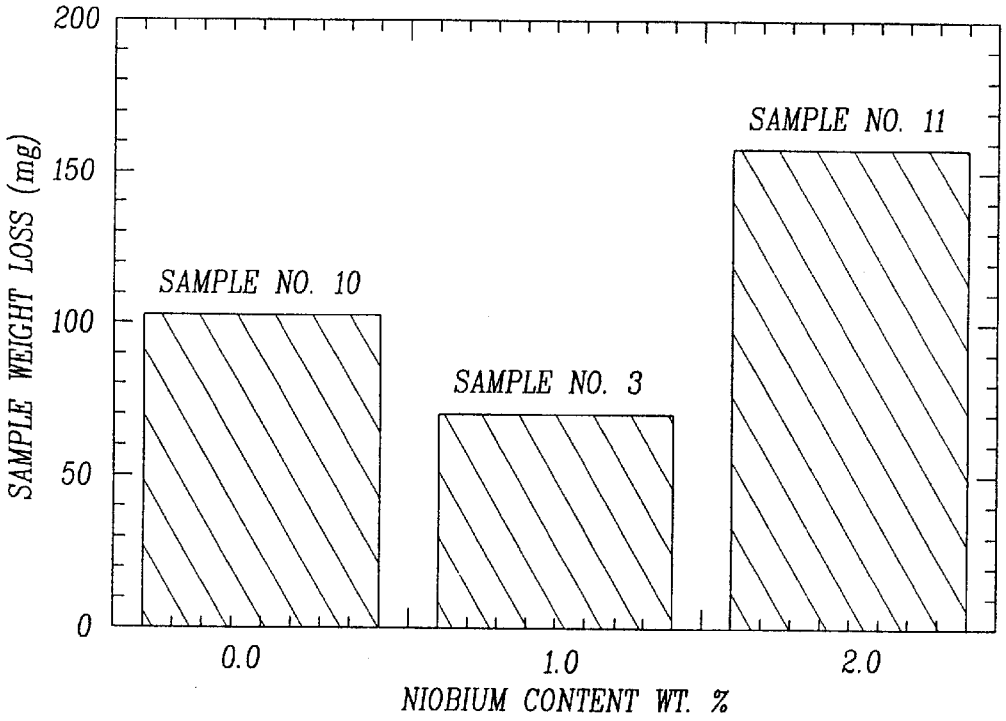
Fig-3
Fig-4
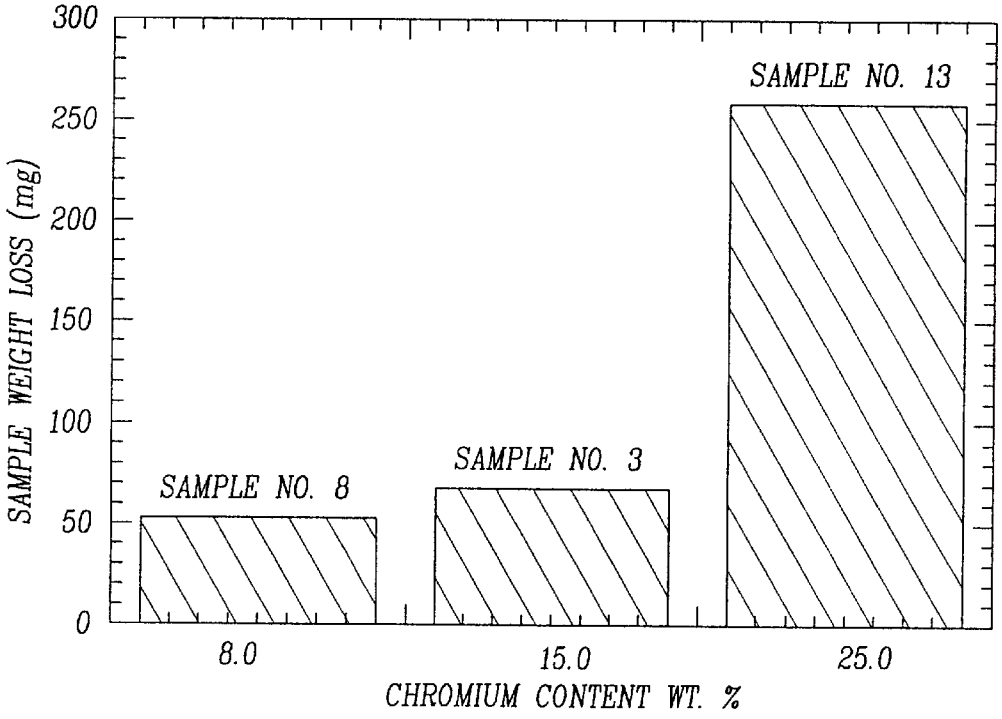

NICKEL-IRON BASE WEAR RESISTANT ALLOY

This invention relates to wear resistant nickel-iron base alloys. In particular, it relates to nickel-iron base alloys which are especially useful for internal combustion engine components such as valve seat inserts, etc.

BACKGROUND OF THE INVENTION

In internal combustion engines, nickel base alloys with high carbon and high chromium content (i.e., about 20 wt. % or greater) have been widely used as exhaust valve seat insert materials because of their good wear resistance and excellent oxidation resistance as well as excellent hot hardness properties. The microstructures of these nickel base alloys can be characterized as high volume fraction of massive $M_7C_3$ and $M_{23}C_6$ type carbides embedded in a nickel rich solid solution matrix, strengthened by solute atoms like chromium, tungsten or molybdenum elements. Often these alloys require a high percentage of expensive nickel element (i.e., about 45 wt. % or greater) and even a certain amount of cobalt in some alloys, contributing to the high cost of manufacturing these alloys.

Exhaust valve seat inserts made from these alloys generally provide satisfactory service life in the current diesel fuel engines. However, as emission standards tend to become tighter, less combustion deposits are available as media between valve and insert seating surfaces that, in the past, have served as a protective coating to reduce direct metal-to-metal contact between the valve and valve seat members. As such deposits become less available, the traditional nickel base alloys are prone to undesirable metallic sliding wear due to such metal-to-metal contact due to their microstructures and chemical compositions of the matrix, and thus direct metal-to-metal contact of valve and valve seat insert surfaces leads to premature wear of valve seat inserts. Moreover, ever increasing demand on engines for more power output per unit cylinder volume increases the load and worsens the working conditions of these nickel base alloys.

Many of the traditional nickel base alloys originated from materials used in valve hardfacing applications, where hot hardness and oxidation resistance are of special importance to these alloys because of much higher temperature (i.e., about 1200° F.) at the working surfaces of valves. However, valve seat inserts per se are not subjected to such high working temperatures (i.e., typically only around 800° F.), and as such the materials they are made from do not need to exhibit the same hot hardness and oxidation resistance properties, because of their lower working temperature. Hence there is a need in the industry for a nickel base alloy with improved sliding wear resistance and with other engineering properties which are specifically adapted for valve seat insert applications.

An essential feature of many prior art nickel base alloys is that high chromium content is required to obtain maximum corrosion resistance or to form acicular chromium carbide for better abrasion resistance, as disclosed, for example, in U.S. Pat. Nos. 4,075,999, 4,191,562, 4,228,223, 4,430,297, 5,246,661, 5,360,592, where chromium ranges between 20.0 to 30.0 wt. % or higher. Several well known commercial valve seat insert alloys, as shown in Table 1 below, belong to this group because of their high chromium content. Some of these nickel base alloys at the same time control iron content to a minimum or low level, as described, for example, in U.S. Pat. Nos. 4,075,999, 4,191,562, 4,228,223 and 4,279,645. For better high temperature properties, a certain amount of cobalt is added to some nickel base alloys, as shown, for example, in U.S. Pat. Nos. 4,191,562 and 4,279,645.

U.S. Pat. No. 4,810,464 discloses an iron base alloy with 27.0 to 43.0 wt. % nickel, 0.1 to 5.0 wt. % silicon, up to 10.0 wt. % chromium, 0.2 to 1.5 wt. % carbon, 3.0 to 5.0 wt. % boron. Noticeably, refractory elements such as molybdenum and tungsten are absent in the alloy, indicating the alloy is intended for moderate temperature applications.

Another known wear resistant nickel base alloy is a composition containing 0.3–2.0 wt. % C, 15.0–25.0 wt. % Cr, 2.0–5.0 wt. % Mo, 1.0–12.0 wt. % Fe, 5.0–20.0 wt. % Co, 0.5–2.0 wt. % Al, as disclosed in U.S. Pat. No. 4,279,645, where high tensile strength at elevated temperatures is the primarily objective for aircraft gas turbine applications.

A nickel-iron base alloy (U.S. Pat. No. 4,292,074), used for rocker arm pads in overhead camshaft combustion engines contains essentially 0.5–2.0 wt. % C, 6–1.0 wt. % Si, 0.5–3.0 wt. % B, 30.0–60.0 wt. % Fe, 30.0–60.0 wt. % Ni, and the total amount of Cr, Mo, and W is 2.0–8.0 wt. %. As disclosed in the patent, maximum wear resistance is obtained when silicon content is in the 6.0 to 10.0 wt. % range under lubricated condition.

TABLE 1

Some Prior Art Valve Seat Insert Alloy Compositions (wt. %)

| Alloy Name | C | Si | Cr | Mo | W | Co | Fe | Ni |
|---|---|---|---|---|---|---|---|---|
| W230 (Eatonite 8) | 1.8–2.5 | 1.5 Max. | 27.0–31.0 | 7.0–9.0 | 1.0 Max. | — | 25.0 Max. | Bal. |
| W240 (Eatonite 2) | 2.0–2.75 | 1.0 Max. | 27.0–31.0 | — | 14.0–16.0 | — | 8.0 Max. | Bal. |
| W250 | 2.25–2.75 | .4–1.1 | 26.5–30.5 | 1.5–2.5 | 1.5–2.5 | 15.0–18.0 | 9.0 Max. | Bal. |
| W260 (Eatonite) | 2.0–2.75 | 1.0 Max. | 27.0–31.0 | — | 14.0–16.0 | 9.0–11.0 | 8.0 Max. | Bal. |
| W280 (Super Eatonite) | 1.3–1.5 | 1.0 Max. | 25.0–28.0 | 9.0–11.0 | 9.0–11.0 | 9.0–11.0 | 10.5–14.0 | Bal. |

SUMMARY OF THE INVENTION

A nickel-iron base alloy according to the invention has a chemical composition consisting essentially of

| Element | wt. % |
|---|---|
| Carbon | 1.0–2.5 |
| Silicon | 1.5–4.5 |
| Chromium | 8.0–20.0 |
| Molybdenum and/or tungsten | 9.0–20.0 |
| Iron | 20.0–40.0 |
| Niobium | 0.5–2.0 |
| Nickel | Bal. (>25.0) |

The alloy is particularly suitable as valve seat insert material and exhibits excellent sliding wear resistance and good hot hardness properties compared with known prior art commercial nickel base valve seat insert alloys. The relatively low levels of chromium and nickel and the relatively high level of iron together with controlling the other constituents in the specified ranges generate an alloy having the desirable sliding wear resistance and hot hardness properties, but at far less cost than the tradition prior art nickel base valve seat insert alloys.

Various metal components can be manufactured from the alloy that would benefit from such properties by various techniques, such as casting, or powder metal forming and sintering. Furthermore, the alloy may be used to hardface the components as a protective coating.

BRIEF DESCRIPTION OF THE DRAWINGS

Presently preferred embodiments of the invention are disclosed in the following description and in the accompanying drawings, wherein:

FIG. 3 is a graph showing the effects of niobium content on wear resistance of sample alloys of the invention;

FIG. 4 is a graph showing the effects of chromium content on wear resistance of sample alloys of the invention;

DESCRIPTION OF THE PREFERRED EMBODIMENTS

Figure 1:
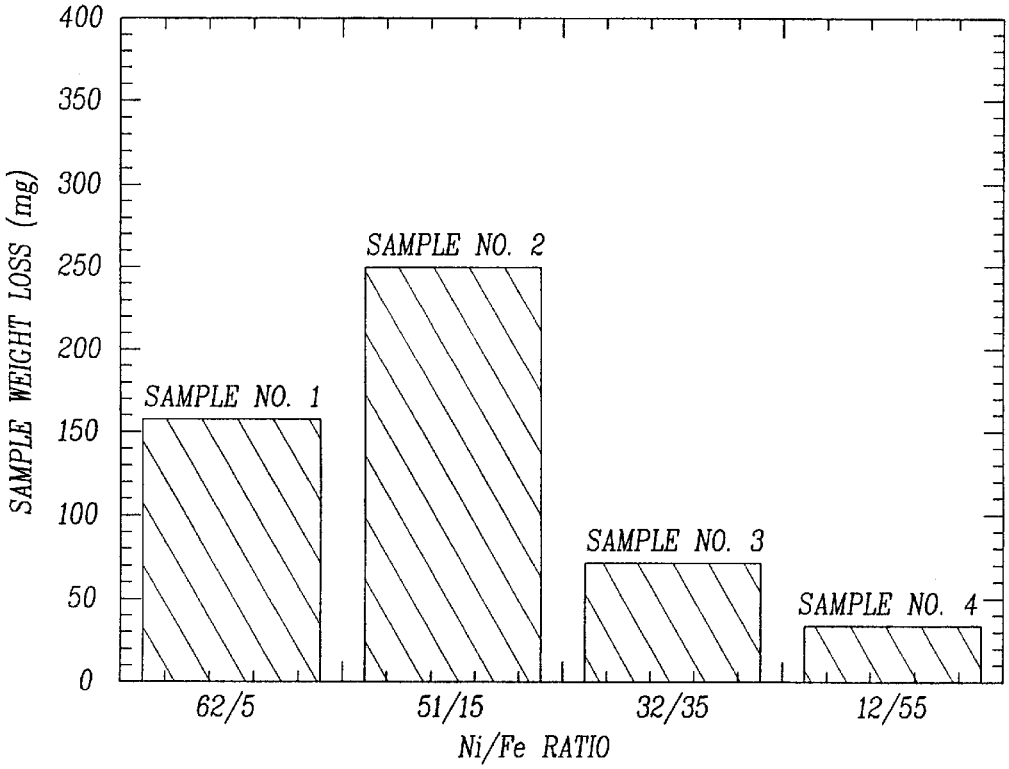
FIG. 1 is a graph showing the effects of different nickel to iron ratios on wear resistance of sample alloys of the invention.

One characteristic feature of alloys according to the present invention is that they contain a significant amount of iron, ranging from 20.0 to 40.0 wt. %. The addition of iron to the invented alloy not only reduces the cost of the nickel base alloys, but it also improves high temperature sliding wear resistance of the alloy, as will be described in greater detail below. The fine microstructure of the invented alloy is obtained through controlling the amount of carbon and alloying elements without sacrificing the hardness of the alloy. The inclusion of a small amount of niobium (i.e., on the order of about 1.0–2.0 wt. %) also helps refine the microstructure of the alloy. Silicon is another important element in the alloy that, when controlled in the specified range given in Table 2, yields excellent sliding wear resistance with reasonable ductility.

EXAMPLES

Seventeen different alloy samples of the present invention (given in Table 2), and the five prior art alloys of Table 1 were cast and machined for room temperature hardness, hot hardness and wear tests. The nominal compositions of the samples according to the invention are provided in Table 2. The cast samples were heat treated at about 1200° F. for about 2 hours and then air cooled to relieve internal stress and to standardize the samples.

Hot hardness of each sample alloy was measured in a Vickers type high temperature hardness tester at specific temperature. Ring specimens with 45 mm outer diameter, 32 mm inner diameter and 5 mm thickness were used as hot hardness specimens. All specimens were ground using 180, 400, and 600 SiC sand papers, then polished with 6 $\mu$m diamond paste and 0.02 $\mu$m alumina slurry, respectively. The specimen and the indentor were kept at 1200° F. (649° C.) for 30 minutes under argon atmosphere to ensure uniform temperature in both the specimen and indentor. The Vickers indentor is made of sapphire with a 136 degree face angle. According to ASTM Standard Test Method E92082, 10 to 15 indentations were made along each ring specimen surface. The two indentation diagonals of each indentation were measured using a filar scale under a light microscope, and the values converted to Vickers hardness number using ASTM E140-78 Standard Hardness Conversion Table for Metals.

TABLE 2

| | Alloy Nominal Chemical Compositions (wt. %) (Vickers Hardness: kgf./mm$^2$) | | | | | | | | | |
|---|---|---|---|---|---|---|---|---|---|---|
| Sample No. | C | Si | Cr | Mo | W | Nb | Fe | Ni | Hardness (Room Temp.) | Hardness 1200° F. (649° C.) |
| 1 | 1.7 | 3.0 | 15.0 | — | 12.0 | 1.0 | 5.0 | 62.0 | 384 | 302 |
| 2 | 1.7 | 3.0 | 15.0 | — | 12.0 | 1.0 | 15.0 | 51.0 | 374 | 298 |
| 3 | 1.7 | 3.0 | 15.0 | — | 12.0 | 1.0 | 35.0 | 32.0 | 387 | 253 |
| 4 | 1.7 | 3.0 | 15.0 | — | 12.0 | 1.0 | 55.0 | 12.0 | 423 | 236 |
| 5 | 2.0 | 1.0 | 15.0 | — | 12.0 | — | 35.0 | 35.0 | 383 | 292 |
| 6 | 2.0 | 2.0 | 15.0 | — | 12.0 | — | 25.0 | 38.0 | 358 | 278 |
| 7 | 2.0 | 3.0 | 15.0 | — | 12.0 | — | 35.0 | 32.0 | 396 | 275 |
| 8 | 2.0 | 4.0 | 15.0 | — | 12.0 | — | 35.0 | 31.0 | 379 | 272 |
| 9 | 2.0 | 6.0 | 15.0 | — | 12.0 | — | 35.0 | 30.0 | 466 | 243 |
| 10 | 1.7 | 3.0 | 15.0 | — | 12.0 | — | 35.0 | 33.0 | 383 | 225 |
| 11 | 1.7 | 3.0 | 15.0 | — | 12.0 | 2.0 | 35.0 | 31.0 | 386 | 257 |
| 12 | 1.7 | 3.0 | 8.0 | — | 12.0 | 1.0 | 35.0 | 32.0 | 381 | 245 |
| 13 | 1.7 | 3.0 | 25.0 | — | 12.0 | 1.0 | 35.0 | 22.0 | 388 | 270 |
| 14 | 1.7 | 3.0 | 15.0 | 12.0 | — | 1.0 | 35.0 | 32.0 | 421 | 293 |
| 15 | 1.7 | 3.0 | 15.0 | 6.0 | 6.0 | 1.0 | 35.0 | 32.0 | 393 | 306 |
| 16 | 2.4 | 0.5 | 15.0 | — | 15.0 | — | 35.0 | 32.0 | 419 | 286 |
| 17 | 2.4 | 0.5 | 15.0 | — | 20.0 | — | 35.0 | 27.0 | 391 | 290 |

The effects of several alloying elements on hot hardness of the alloy were measured at 1200° F. (649° C.), since hot hardness of most nickel base alloys begins to drop quickly when testing temperature reaches 1200° F. (649° C.). Nickel and iron are two important elements affecting the hot hardness of the alloy. To study the effects of nickel to iron ratio on hot hardness of the alloy, four sample alloys (samples 1–4) were prepared by changing the ratio of nickel to iron while other elements in the alloy were kept the same. As shown in Table 2, decreasing the ratio of nickel to iron decreases the hot hardness of the alloy at 1200° F. (649° C.), and its influence on room temperature hardness is obvious only when nickel to iron ratio is up to 12 wt. %/55 wt. %, where hardness of the alloy has the maximum value which is approximately 20% higher than other nickel/iron ratio alloys.

Increasing silicon content (samples 5–9) has the effect of decreasing the hot hardness of the alloy. An addition of 6 wt. % silicon (sample 9) has the effect of significantly increasing room temperature hardness of the alloy (Table 2).

Chromium is more effective than tungsten in raising the hot hardness since there is only a slight increase of hot hardness when tungsten changes from 15.0 to 20.0 wt. % (samples 16 and 17), while significant increase of hot hardness is observed when chromium increases from 8.0 to 25.0 wt. % (samples 12 and 13).

Additions of small amounts of niobium (samples 3 and 10) can also effectively improve the hot hardness of the alloys, however, further increasing of niobium from 1.0 to 2.0 wt. % (sample 11) does not yield any appreciable increase in the hot hardness of the alloy.

A high temperature pin-on-disk wear tester was used to measure the sliding wear resistance of the alloy samples. Sliding wear is an important consideration in the wear mechanism of valve seat inserts due to relative sliding motion that occurs between the valves and valve seat inserts in internal combustion engines. The pin specimen was 6.35 mm in diameter and approximately 25.4 mm long and was made of Inconel 751, a common valve alloy used for diesel engines. The disks were made of insert alloys of Table 2 with dimensions of 50.8 mm in diameter and 12.5 mm thickness. The testing temperature was 800° F. (427° C.), as the exhaust valve seat inserts normally work at this temperature. The tests were performed with reference to ASTM G99-90. The disk samples were rotated at a velocity of 0.13 m/s for a total sliding distance of 255 m. The weight loss was measured on both the pin and the disk samples after each test using a balance with 0.1 mg precision.

The graph of FIG. 1 shows the effect nickel to iron ratio has on the wear resistance of the alloys. Contradictory to its effects on hot hardness, decreasing nickel to iron ratio improves wear resistance of the alloy at 800° F. (427° C.) because of the possible influence that the lower ratio may have on the plastic deformation ability of nickel matrix and the formation of iron-rich silicides. Although 12 wt. %/55 wt. % nickel/iron ratio yields minimum weight loss among sample alloys with different nickel to iron ratios, one would expect that the plastic deformation ability would be dramatically reduced in such a low nickel/iron ratio, which may reduce service life of the valve seat inserts made from the alloy in certain engines. Noticeably, significant decrease of weight loss occurs as nickel to iron ratio decreases from 51 wt. %/15 wt. % to 32 wt. %/35 wt. %, and the maximum weight loss appears at relatively high nickel to iron ratio of 51%/15%.

Figure 2:
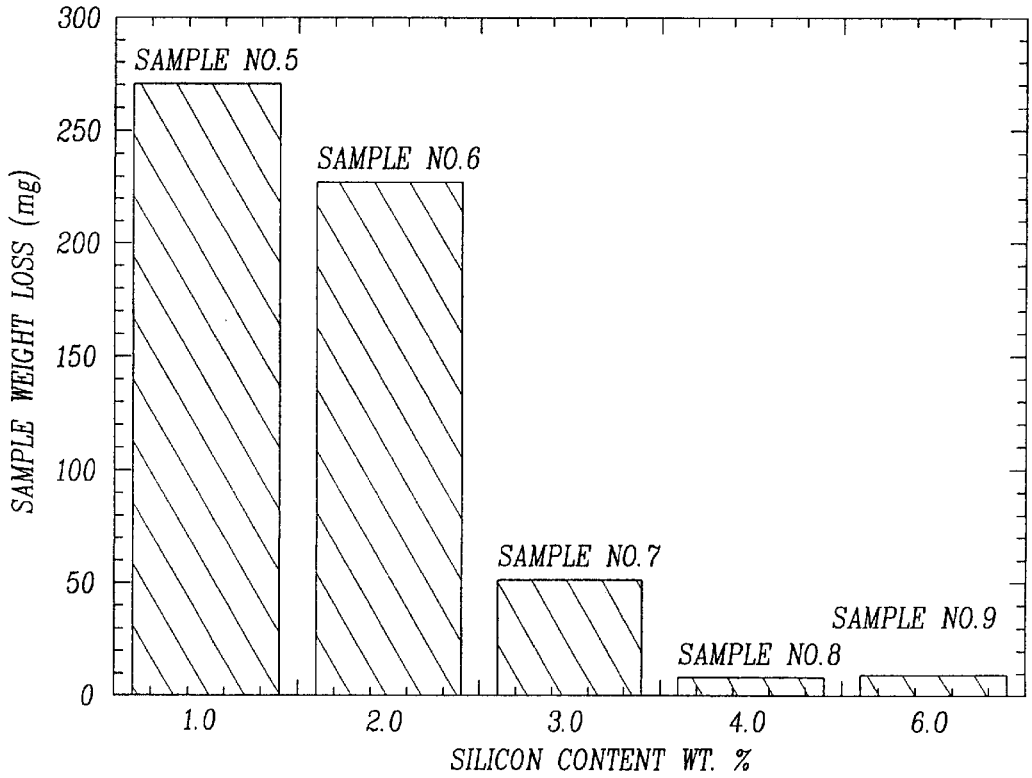
FIG. 2 is a graph showing the effects of silicon content on wear resistance of sample alloys of the invention.

Silicon shows a powerful effect on the sliding wear resistance of the alloy. As shown in FIG. 2, additions of silicon can significantly improve the sliding wear resistance of the alloy when silicon content increases from 1.0 to 4.0 wt. %. Drastic improvement of sliding wear resistance of the alloy is observed when silicon increases from 2.0 to 4.0 wt. % in spite of a 10% decrease in iron content in sample alloy No. 6. Suprising, however, wear resistance begins to decrease as silicon content approaches 6.0 wt. % which is believed to occur because the alloy becomes more brittle due to the formation of more silicides. Although 4.0 wt. % silicon gives the best sliding wear resistance among all sample alloys, the actual service life of valve seat inserts made from the alloy having somewhat lower levels of silicon may be more favorable due to increase in plastic deformation associated with lower silicon levels. It will thus be appreciated that the optimum silicon content takes into account several important properties of valve seat inserts, with a silicon content of approximately 3.0 wt. % being preferred.

The addition of a small amount of niobium improves wear resistance of the alloy as shown in FIG. 3. However, further addition of niobium to the alloy has the effect of reducing the wear resistance of the alloy.

The effect that chromium has on wear resistance of the alloy is illustrated in FIG. 4, where lower chromium concentration tends to increase sliding wear resistance of the alloy. However, too low of chromium content much below 8.0 wt. % exhibits poor oxidation resistance. The weight loss of the alloy increases more than three times when chromium changes from 15.0 to 25.0 wt %.

Figure 5:
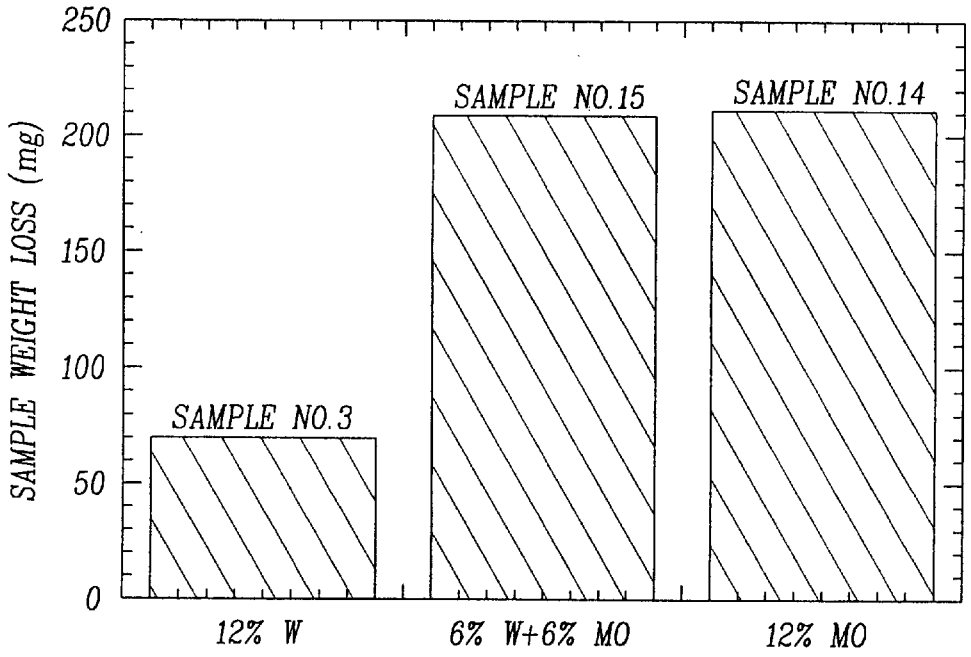
FIG. 5 is a graph showing the effects of a tungsten and molybdenum content on wear resistance of sample alloys of the invention.

The influence of refractory alloy elements, tungsten and molybdenum, on sliding wear resistance of the alloy is also compared in FIG. 5. The weight loss is minimum when tungsten is used as the only refractory alloy element as shown in FIG. 5, where sample alloys with 6.0 or 12.0 wt. % molybdenum show much higher weight loss than sample alloys containing only tungsten element.

Figure 6:
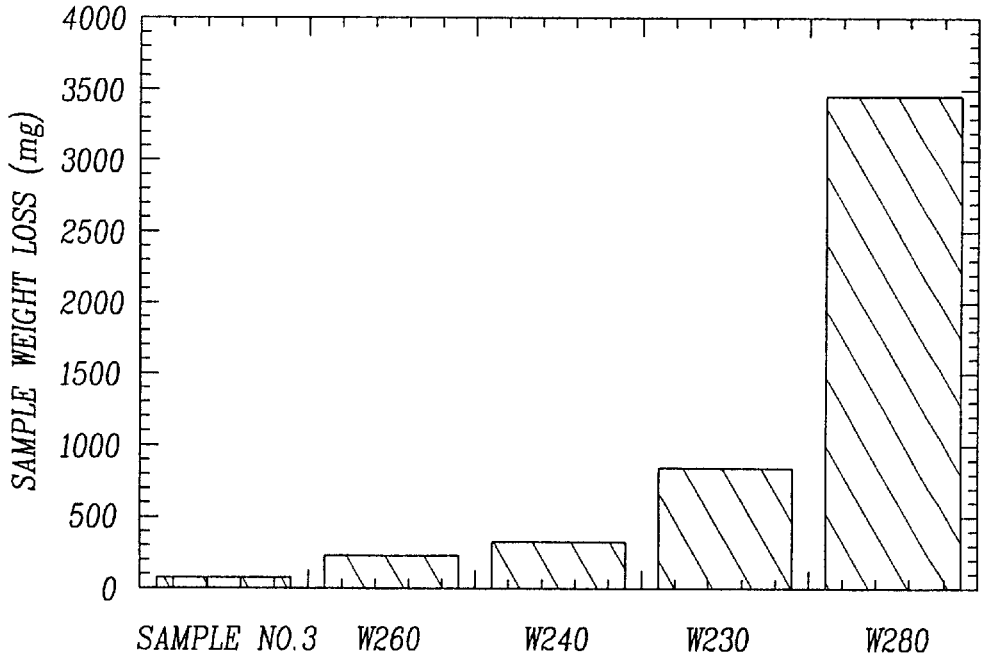
FIG. 6 is a graph showing the wear resistance of a sample alloy of the invention compared to several prior art alloys.

FIG. 6 is a comparison of wear resistance of prior art nickel base valve seat insert alloys in Table 1 with sample No. 3 alloy, which shows that the sliding wear resistance of the present invention alloy is superior over the prior art alloys. Moreover, the cost of the present invention alloy is significantly lower than the prior art alloys due to the existence of large amounts of iron in the present alloys, which also allows the use of ferro-tungsten and ferro-chromium as raw materials to further lower the alloy cost.

Figure 7:
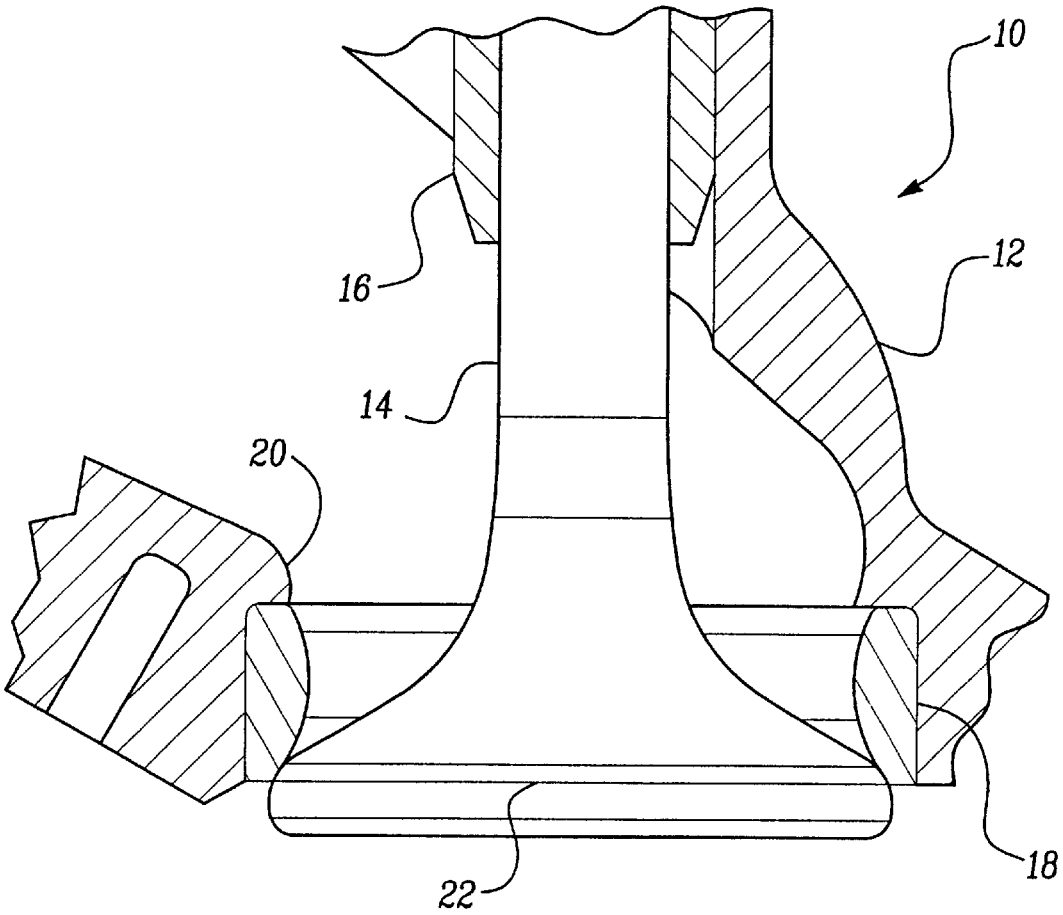
FIG. 7 is an enlarged, fragmentary cross-sectional view of an internal combustion engine having a valve seat insert of the invention mounted therein.

FIG. 7 is an enlarged, fragmentary, cross-sectional view of an internal combustion engine 10 having a head 12 with a valve guide 16 slideably supporting a valve 14. A valve seat insert 18, constructed in accordance with the invention from the alloy material, is mounted such as by press-fitting at the mouth of an intake or exhaust port 20 of the engine for interacting with the head 22 of the valve to open and close the port 20 in known manner. Valve seat inserts 18 fabricated of the alloys of the present invention exhibit excellent wear resistance to sliding contact with the valve head 22, and combined good hot hardness properties as well.

It will be appreciated that the valve seat insert 18 is but one of numerous metal articles of manufacture, and particularly internal combustion engine components that may utilize the alloy of the invention. Accordingly, it will be-understood that the invention has equal applicability to articles of manufacture in general. The invention is preferably concerned with a valve seat insert member fabricated of an alloy consisting essentially of, in weight percent: about 1.0 to 2.5 carbon, about 1.5 to 4.5 silicon, about 8.0 to 20.0 chromium, about 20.0 to 40.0 iron, about 0.5 to 2.0 niobium, about 9.0 to 20.0 selected from the group consisting of molybdenum and tungsten, and the balance nickel in excess of about 25.0.

Preferably, the valve seat member contains an amount of molybdenum and/or tungsten in the range of about 10.0 to 14.0 wt. %.

Preferably, the valve seat member is comprised of an amount of silicon in the range of about 2.5 to 3.5 wt. %.

Preferably, the valve seat member is comprised of an amount of chromium in the range of about 12.0 to 18.0 wt. %.

Preferably, the valve seat member is comprised of an amount of niobium in the range of about 0.7 to 1.3 wt. %.

Preferably, the valve seat member is comprised of an amount of iron in the range of about 32.0 to 37.0 wt. %.

Preferably, the valve seat member is comprised of an amount of nickel in an amount greater than about 30.0 wt. %.

The disclosed embodiments are representative of a presently preferred form of the invention, but are intended to be illustrative rather than definitive thereof. The invention is defined in the claims.

We claim:

1. A valve seat insert member fabricated of an alloy consisting essentially of, in weight percent: about 1.0 to 2.5 carbon, about 1.5 to 4 .5 silicon, about 8.0 to 20.0 chromium, about 20.0 to 40.0 iron, about 0.5 to 2.0 niobium, about 9.0 to 20.0 selected from the group consisting of molybdenum and tungsten, and the balance nickel in excess of about 25.0.

2. The member of claim 1 wherein molybdenum and tungsten are present in the range of about 10.0 to 14.0 wt. %.

3. The member of manufacture of claim 1 wherein said amount of silicon is present in the range of about 2.5 to 3.5 wt. %.

4. The member of manufacture of claim 1 wherein said amount of chromium is present in the range of about 12.0 to 18.0 wt. %.

5. The member of manufacture of claim 1 wherein said amount of niobium is present in the range of about 0.7 to 1.3 wt. %.

6. The member of manufacture of claim 1 wherein said amount of iron is present in the range of about 32.0 to 37.0 wt. %.

7. The member of manufacture of claim 1 wherein said nickel is present in an amount greater than about 30.0 wt. %.

* * * * *